US009585220B2

(12) United States Patent
Hartmann et al.

(10) Patent No.: US 9,585,220 B2
(45) Date of Patent: Feb. 28, 2017

(54) OPERATION OF AN LED LUMINAIRE HAVING A VARIABLE SPECTRUM

(75) Inventors: Martin Hartmann, Dornbirn (AT); Christoph Platzer, Gleisdorf (AT)

(73) Assignees: Tridonic GmbH & Co. KG, Dornbirn (AT); Tridonic Jennersdorf GmbH, Jennersdorf (AT)

( * ) Notice: Subject to any disclaimer, the term of this patent is extended or adjusted under 35 U.S.C. 154(b) by 8 days.

(21) Appl. No.: 13/503,554

(22) PCT Filed: Oct. 22, 2010

(86) PCT No.: PCT/EP2010/065982

§ 371 (c)(1),
(2), (4) Date: Jun. 12, 2012

(87) PCT Pub. No.: WO2011/048214

PCT Pub. Date: Apr. 28, 2011

(65) Prior Publication Data

US 2012/0242247 A1 Sep. 27, 2012

(30) Foreign Application Priority Data

Oct. 23, 2009 (DE) ..... 10 2009 050 479
Jan. 14, 2010 (DE) ..... 10 2010 000 903

(51) Int. Cl.
*H05B 33/08* (2006.01)

(52) U.S. Cl.
CPC ..... *H05B 33/0863* (2013.01)

(58) Field of Classification Search
CPC .... G05B 11/01; H05B 37/02; H05B 33/0815; H05B 33/0845; Y02B 20/42; Y02B 20/36
USPC ..... 315/294, 224, 291, 247, 192; 700/18
See application file for complete search history.

(56) References Cited

U.S. PATENT DOCUMENTS

| | | | | |
|---|---|---|---|---|
| 7,902,771 | B2 * | 3/2011 | Shteynberg et al. | 315/307 |
| 8,018,172 | B2 * | 9/2011 | Leshniak | 315/194 |
| 8,264,169 | B2 * | 9/2012 | Shteynberg et al. | 315/307 |
| 2002/0078221 | A1 * | 6/2002 | Blackwell et al. | 709/231 |
| 2003/0028260 | A1 * | 2/2003 | Blackwell | 700/18 |
| 2004/0105261 | A1 * | 6/2004 | Ducharme | H05B 33/0857 362/231 |
| 2004/0116039 | A1 * | 6/2004 | Mueller et al. | 446/220 |
| 2004/0178751 | A1 * | 9/2004 | Mueller et al. | 315/294 |

(Continued)

OTHER PUBLICATIONS

Author: Microchip, Title: PIC12F629/675, Date: Dec. 2003.*

(Continued)

*Primary Examiner* — Douglas W Owens
*Assistant Examiner* — Wei Chan
(74) *Attorney, Agent, or Firm* — The H.T. Than Law Group

(57) ABSTRACT

The invention relates to a method for controlling the operation of an LED luminaire (1) which has a plurality of LEDs (5, 6) as light sources. The method has the following steps:

evaluation, by a control unit (3) for the LED luminaire (1), of an electrical signal which is produced by a switch, pushbutton or dimming switch (10) which can be operated by a user (11) and is connected to the control unit (3) and supplied with voltage via an interface (23) of the LED luminaire (1), and variation of the color spectrum of the LED luminaire (1) as a function of the evaluated signal.

14 Claims, 5 Drawing Sheets

(56) References Cited

U.S. PATENT DOCUMENTS

| | | | | |
|---|---|---|---|---|
| 2004/0264193 | A1* | 12/2004 | Okumura | A61B 19/52 362/276 |
| 2005/0253533 | A1* | 11/2005 | Lys et al. | 315/224 |
| 2006/0012315 | A1* | 1/2006 | McDonough et al. | 315/291 |
| 2006/0012987 | A9* | 1/2006 | Ducharme | H05B 33/0863 362/231 |
| 2008/0116818 | A1* | 5/2008 | Shteynberg et al. | 315/192 |
| 2009/0085496 | A1* | 4/2009 | Osborn | 315/294 |
| 2009/0085497 | A1* | 4/2009 | Osborn | 315/294 |
| 2009/0195189 | A1* | 8/2009 | Zampini | H05B 33/0803 315/295 |
| 2010/0259183 | A1* | 10/2010 | Leshniak | 315/287 |

OTHER PUBLICATIONS

International Preliminary Report on Patentability in connection to corresponding International Application No. PCT/EP2010/065982. International Search Report issued in connection with the corresponding International Application No. PCT/EP2010/065982 on Mar. 18, 2011.

* cited by examiner

OPERATION OF AN LED LUMINAIRE HAVING A VARIABLE SPECTRUM

BACKGROUND OF THE INVENTION

The present invention relates to a method for controlling the operation of an LED luminaire, and to an LED luminaire designed for this purpose. In particular, the invention in this case relates to so-called retrofit LED luminaires, that is to say LED luminaires which are designed such that they can be used as an incandescent bulb substitute or a low-voltage or 12-volt halogen lamp substitute.

Incandescent lamps and halogen lamps in which the original light source is replaced by gas discharge lamps or LEDs are being used increasingly, and are available from various manufacturers. In this case, the production of a pleasant light represents a particular requirement. In particular, a pleasant color temperature is required. In this case, a color temperature which appears to be pleasant can be chosen as a function of various constraints. For work, for example, a cooler light is preferred while, in contrast, a warm color temperature is generally found to be more pleasant for leisure purposes. Furthermore, a different color temperature can lead to different color reproduction. A specific color temperature may accordingly be advantageous depending, for example, on the dwelling facility. Overall, an individually adjustable color temperature can therefore be considered desirable.

Virtually fundamentally, a normal building has the same power supply means. The power supply means for illumination in this case consists of wiring, which carries the mains AC voltage and is laid in walls and ceilings such that connection facilities for luminaires are located at predetermined points on the ceilings and walls.

This wiring has switches for the user to control these lamps, that is to say to switch the electric current that is supplied on and off. These are normally on/off switches, that is to say toggle switches, which provide two different values (on and off) in two different positions of a toggle, and switches which act as momentary-contact switches or pushbuttons. The latter have only one possible position, with the currently selected value being changed by pushing the pushbutton (a lamp which is switched off is switched on by pushing, for example).

A further option in existence is dimming switches, which have the same features as pushbuttons or switches and can additionally dim the lamp by turning the dimming switch in a sideways direction. The dimming is normally carried out by varying the voltage profile (for example by means of so-called phase on-gating or phase off-gating) or the power. These dimming switches are normally formed by electronic circuits and in this case also contain electronic switches such as diacs, triacs, thyristors or MOSFETs. In modern power supply means, such as those used in relatively modern buildings, the lighting can also be dimmed continuously via a dimming pushbutton which, in addition to the rotatable dimming switch, represents a further embodiment of a dimming switch for continuous, that is to say infinitely variable, brightness variation. In this case, a lamp which is switched off is switched on by briefly pressing once. As normal, this lamp can now be switched off by briefly pressing once again. However, if the pushbutton is pushed for a relatively long time with the lamp in the switched-on state, then the lamp is dimmed. This means that the lighting intensity of the at least one connected lamp decreases slowly but continuously. The current dimming level is maintained when the pushbutton is released again. The dimming value therefore oscillates cyclically if the pushbutton is pressed continuously.

In summary, a switch such as this can therefore be regarded as a user interface for the lighting system consisting of wiring and at least one luminaire.

Furthermore, a switching actuator which is controlled via a bus could also be used as a switch or dimming switch.

Furthermore, the power for a conventional lighting system may be supplied in the low-voltage range. This is the case in particular when using halogen lamps. A mains switching unit is for this purpose connected to the wiring which carries the main alternating current, and is generally mounted on the ceiling or on the wall, in the vicinity of the halogen luminaires. The mains switching unit now converts the mains AC voltage to a low-DC voltage, and thus supplies the one or more halogen lamps, often via exposed lines. The already installed switch is once again used for user control, in which case a dimming switch can likewise be used to dim the halogen lighting system.

In the situation in which the power supply means in the building cannot have a dimming switch, it is nevertheless desirable to dim the lighting. Lamps have been developed for this situation, such as the "Dulux L Vario" lamp type from the OSRAM Company, which can be screwed into conventional lamp sockets and can be operated using 230 volts AC voltage. In this case, as a light source, the lamp has a gas discharge lamp, and has additional electronics, which are designed for operation of the light source in various modes. The various modes in this case correspond to different brightnesses. When the lamp is switched on for the first time or after having been switched off for a relatively long time, it is first of all operated at 20 watts. If the lamp is now switched off again and is switched on again within three seconds, it is now operated with a power of only 8 watts. A lamp such as the Osram Dulux L Vario therefore allows stepped dimming, in which different discrete dimming values can be set by means of a conventional light switch, by switching it on and off repeatedly.

Because of the positive characteristics of LEDs and OLEDs, and their continual technical further developments, there is an increasing demand for light sources which have LEDs or OLEDs.

Because of the requirements described above, the invention is based on the object of providing a method for controlling the operation of an LED luminaire, as well as an LED luminaire which is designed for this purpose, in which individual settings, in particular of the color temperature, are possible, and which can nevertheless be operated and controlled using conventional power supply means.

The object is achieved by the features of the independent claims. The dependent claims develop the central concept of the invention in a particularly advantageous manner. The invention therefore relates to a method for controlling the operation of an LED luminaire which has a plurality of LEDs as light sources. The method in this case has the following steps: firstly, a control unit evaluates the LED luminaire, by evaluating an electrical signal which is produced by a switch, pushbutton or dimming switch. The switch, pushbutton or dimming switch is in this case supplied with current. In this case, the signal is produced by the user, by operating the switch, pushbutton or dimming switch. Furthermore, the switch, pushbutton or dimming switch is connected to the control unit for the LED luminaire via an interface. In the second step, the color spectrum of the LED luminaire is varied. This variation is carried out as a function of the evaluated signal.

The control unit preferably evaluates the number and/or the time duration of the operation of the switch, pushbutton or dimming switch. Additionally or alternatively, when using a dimming switch, the control unit evaluates the voltage which is passed on from the dimming switch, and/or its time profile.

The LED luminaire may produce white light. The color temperature of this white light may be varied as a function of the evaluated signal.

The color reproduction index of the light from the LED luminaire can likewise be varied as a function of the evaluated signal.

At least one of the LEDs is preferably operated with pulse-width modulation. In this case, the duty ratio of the pulse-width modulation can be varied as a function of the evaluated signal.

Furthermore, it is feasible for the signal also to be evaluated for brightness control of the LED luminaire.

Modulated mains voltage signals can be supplied to the interface through a switch, pushbutton or dimming switch. The mains voltage signals may, for example, be modulated such that the mains voltage is interrupted for a certain time period, or is passed on only for a certain time period. These time periods may also be repeated a number of times. However, the mains voltage signals may, for example, also be modulated by application of higher-frequency signals, for example the use of a phase on-gating dimmer or a phase off-gating dimmer makes it possible to transmit a voltage which is composed of a frequency component of the normal mains voltage (for example 50 Hz) and of higher harmonics (that is to say by way of example, the third, fifth and seventh harmonics). The higher-frequency signals may, however, also be produced by modulation of a higher-frequency control signal (for example by inductive coupling).

In a further aspect, the control unit sends commands, for example in accordance with the DALI Standard, via the same interface or possibly via a further interface. It can preferably receive digital commands in the same manner.

The invention furthermore relates to a control unit, in particular an integrated circuit such as an ASIC or a microcontroller, which is designed to implement a method as described above.

Furthermore, the invention relates to an LED luminaire. This has a supply circuit which supplies a plurality of LEDs, as light sources, from a supply voltage. Furthermore, it comprises a control unit which is designed to evaluate signals which are produced by a switch, pushbutton or dimming switch which can be operated by a user and is connected to the control unit and supplied with voltage via an interface of the LED luminaire. In this case, the control unit is also designed to vary the color spectrum of the LED luminaire as a function of the evaluated signal.

Preferably, the control unit is designed to evaluate the number and/or the time duration of the operation of the dimming switch, switch or pushbutton.

The LED luminaire can produce white light, and the control unit can vary the color temperature of the white light as a function of the evaluated signal.

It is likewise feasible for the control unit to be able to vary the color reproduction index of the light from the LED luminaire as a function of the evaluated signal.

Preferably, the control unit varies (influences) at least one of the LEDs by pulse-width modulation. The duty ratio of the pulse-width modulation can therefore be adjusted as a function of the evaluated signal.

It is also feasible for the control unit to also evaluate the signal for brightness control of the LED luminaire.

The light sources may have at least one RGB-LED module.

It is also possible for the light sources to have at least one dye-converted white LED. In addition, the light sources may have at least one further colored LED. Preferably, the intensities of the white LED and of the further colored LED can be controlled independently of one another by the control unit.

The LED luminaire may be in the form of a retrofit lamp. For this purpose, it may have a halogen or incandescent-lamp cap or halogen lamp pins.

The interface is preferably designed to receive modulated mains voltage signals through a switch, pushbutton or dimming switch. The control unit is preferably designed to adjust the color spectrum of the LED luminaire on the basis of the modulated mains voltage signals. Furthermore, the control unit is preferably designed to receive and/or to transmit digital commands, for example in accordance with the DALI Standard, via the same interface or a further interface.

Finally, the invention relates to an LED lighting system. This has one or more LED luminaires. At least one of these LED luminaires has the features described above. This one LED luminaire is also connected to a dimming switch, switch or pushbutton. This is supplied with voltage.

The dimming switch, switch or pushbutton is preferably supplied with voltage from the LED luminaire, in particular via the interface, or from an external voltage source, in particular a mains voltage.

It is also feasible for the LED luminaire to be supplied with voltage via the switch, pushbutton or dimming switch from an external voltage source, in particular a mains voltage, in which case the LED luminaire supply preferably at the same time forms the interface.

In this case, the switch, pushbutton or dimming switch may be supplied with DC voltage from the LED luminaire, in particular via the interface.

It is also possible to simultaneously also vary the color temperature of the LED luminaire when the brightness is varied. The color temperature is shifted in the direction of a warmer color temperature when the brightness (luminous power) is reduced (or vice versa, that is to say a deliberate variation in the direction of a colder color temperature is also introduced when the brightness is increased).

The color temperature is preferably varied by independent control of at least two light-emitting diodes with different spectra, for example at least one dye-converted white LED and at least one monochromatic LED.

In addition, the LED lighting system may have a central control unit. This is preferably connected to the interface, with the central control unit evaluating commands from the interface and controlling the LED luminaire.

Furthermore, the LED lighting system may have a BUS. The LED luminaires and the central control unit are preferably connected to this BUS. The BUS may also be designed for communication with and/or to supply power to the LED luminaires and the central control unit.

BRIEF DESCRIPTION OF THE DRAWINGS

Further characteristics, advantages and features will now be provided for a person skilled in the art on the basis of the following comprehensive description of one exemplary embodiment, and with reference to the figures in the accompanying drawings, in which.

DETAILED DESCRIPTION OF THE INVENTION

Figure 1:
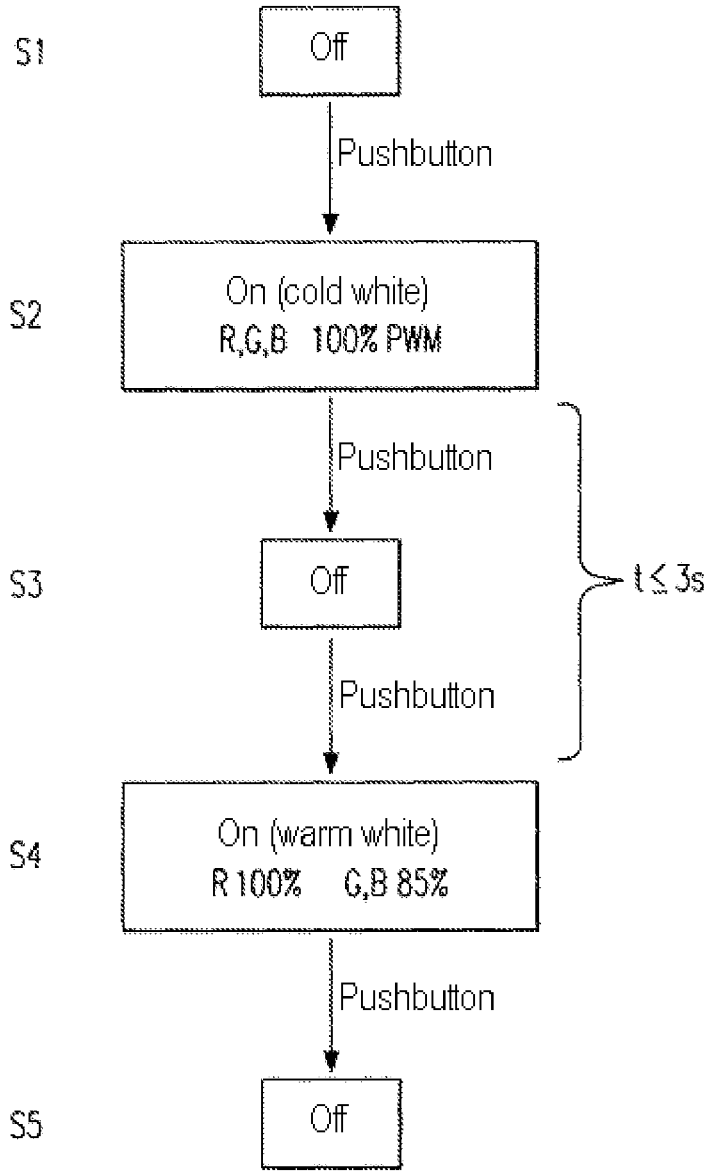
FIG. 1 shows a first embodiment of a method according to the invention for individual adjustment of the color temperature.

FIG. 1 shows a method in which an LED luminaire is operated via a pushbutton. As described initially, the pushbutton has only one state, that is to say the pushbutton is simply pushed once for both switching on and switching off, and preferably always returns to the same rest position by means of a spring. In this example, the LED luminaire has an RGB module which therefore consists at least of a red, a green and a blue LED.

Fundamentally, the invention provides for at least two LEDs to be provided, which have a different spectrum and whose intensities can be controlled independently of one another, in order to produce visible mixed light with a variable spectrum (color, color temperature).

Preferably, light with a constant color, in particular "white" is produced in this way, and only the color temperature is varied. A shift is therefore produced along the Plank white-light curve in the CIE standard color table.

At the time S1, the LED luminaire is in the switched-off state. The LED luminaire is switched on by the pushbutton being operated, that is to say by a user pushing the pushbutton. First of all, the LED luminaire illuminates in a cold white color in S2, that is to say a color temperature with a relatively high value, for example 7500 K. The LED luminaire is switched off again by operating the pushbutton again. If the LED luminaire now remains switched off in S3 only for a predetermined time period t which, for example, is less than 3 s, before the pushbutton is operated again, the LED luminaire illuminates in a warmer white. This means that, in S4, the color temperature of the emitted light is now reduced, for example to a value of 3000 K. Finally, the LED luminaire is switched off again in S5 by operating the pushbutton again.

In one simple case, a control unit for the LED luminaire merely identifies that, as a result of the triple switching operation (on-off-on), the mains voltage on switching on for the second time is not zero, and thus the LED lamp/LED luminaire is illuminated in warm white, instead of cold white. In the embodiment in FIG. 1, the control unit for the LED luminaire may therefore be designed such that, when the LED luminaire is switched on for the first time, it is in principle first of all operated such that it illuminates in a cold white color after a switched-off time period which is longer than the predetermined time period t, for example 30 minutes.

If the LED luminaire is now switched off and is switched on again within the predetermined time period t, for example of 3 seconds, then the control unit can use a timer to determine that the LED luminaire should now be operated in such a way that it illuminates in warm white. In one simple embodiment, the control unit has a capacitor for this purpose, which is charged while the LED luminaire is switched on, and discharges after switching off. In this case, the capacitor is designed such that the voltage across it after the predetermined time period is less than a critical value. Alternatively, of course, it is also possible to use a digital circuit, such as a counter. However, in this case it is in principle desirable for the control unit to also store the most recently selected operating mode of the LED luminaire.

Figure 5:
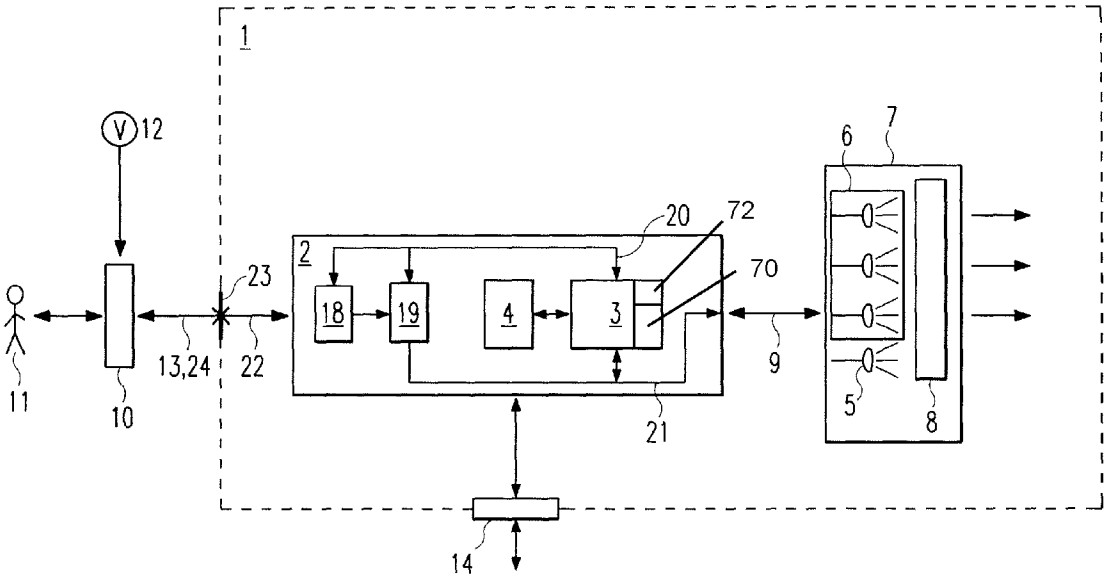
FIG. 5 shows an embodiment according to the invention of an LED luminaire.

A microcontroller 70, which is a component of the control unit 3, can also be used for time measurement. The microcontroller has an energy buffer for this purpose. This is preferably an electrolytic capacitor which is designed to buffer the mains breaks. The energy buffer can therefore be used to count the mains off times, that is to say time durations in which the LED luminaire is switched off. The microcontroller 70 of the control unit 3, as shown in FIG. 5, comprises an element 72, which schematically represents this capacitor or energy buffer, discussed above.

As is indicated in FIG. 1, the color temperature can be varied in a simple manner. While, in S2, all the red, green and blue LEDs illuminate at 100% of their maximum permissible power, the light intensity of the green and blue LEDs is reduced in S4. This proportionally increases the red component of the light emitted from the LED luminaire. At the same time, the overall light intensity of the LED luminaire is slightly reduced. This may in fact be desirable because a warmer light with a lower color temperature has a relaxing effect. Weak illumination is accordingly also possibly desirable, since this additionally results in a more pleasant and relaxing lighting ambiance. However, if the light intensity of the LED luminaire is intended to remain constant, the red, green and blue LEDs can be operated at only 90% of their maximum permissible power in S2, and in S4 the at least one LED can once again be illuminated at 100% of its maximum permissible light intensity, while the green and blue LEDs are operated at only 85% of their maximum permissible power.

A pulse-width modulation method is preferably used to vary the light intensity, in which the light intensity is varied by varying the pulse widths. Furthermore, dimming can be carried out by varying a clock frequency with constant switched-on time periods. It is also feasible to vary the current level flowing through the LEDs in which case it is also necessary to compensate for the variation, which may possibly occur in this case, of the wavelength range of the emitted light. Furthermore, it is expedient for the LEDs of one light color to be controllable by a dedicated channel, by means of pulse-width modulation. This means that each light color can be varied independently of the others.

In summary, in this embodiment according to the invention, the method therefore has three different discrete values, with two values corresponding to two different light modes of the LED luminaire with a different color temperature, and with the third reflecting the switched-off state. Alternatively or additionally, it is also possible to vary the color reproduction index CRI by means of the two different operating modes. This method results in only a slight additional load on the user since he just has to operate the pushbutton more often. The use of the method is also extremely intuitive for the user since, firstly, he does not require any further input means other than the pushbutton, with which he is already familiar. Secondly, the result of his input is made directly evident to him by the variation of the color temperature.

Figure 2:
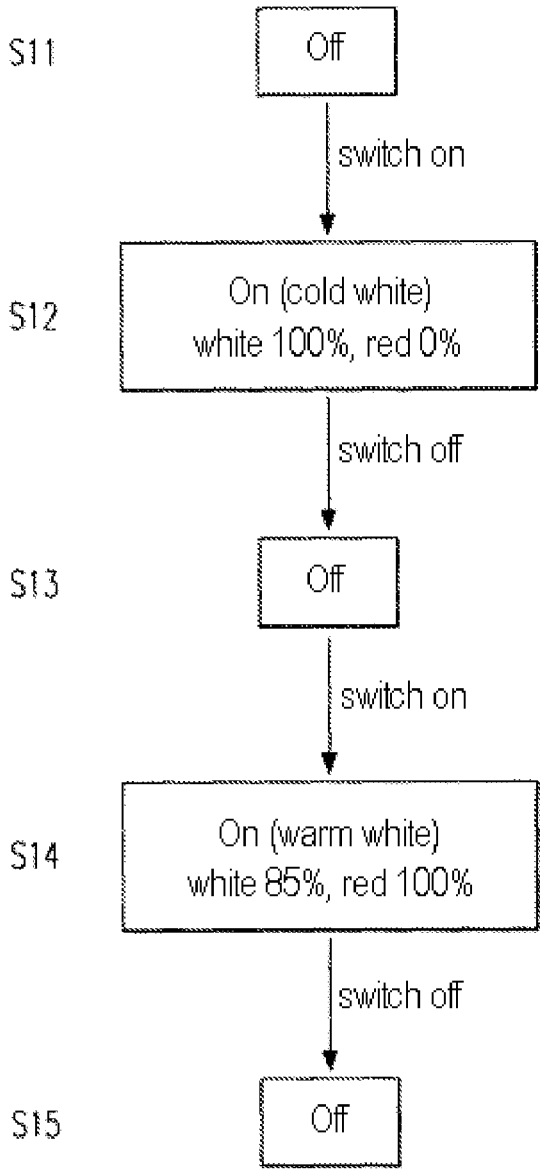
FIG. 2 shows a second embodiment of a method according to the invention for individual adjustment of the color temperature.

FIG. 2 shows a further method for the control according to the invention of the operation of an LED luminaire. This system is similar to the method illustrated in FIG. 1, but uses a toggle switch instead of a pushbutton. In step S11, the LED luminaire is first of all switched off. The LED luminaire is switched on by operation of the switch, that is to say by changing the switch position. In S12, it therefore illuminates in a cold white color. In this case, the LED luminaire in this exemplary embodiment has one or more white LEDs and one or more red LEDs. The white LED is in this case preferably a blue LED which also has wavelength conversion material, such as phosphor, in its emission area. Alternatively, an RGB-LED module can also be used, which has at least one red, green and blue LED. In order to produce the cold-white light in S12, the at least one white LED is operated at 100% of the maximum permissible power. The at least one red LED is in contrast switched off.

The LED luminaire is now switched off by operating the switch again. It is therefore no longer illuminated in S13. If the LED luminaire is now switched on again after a time of any desired duration, then it now illuminates with different light characteristics. As is shown in S14, the at least one white LED is now operated at only 85% of its maximum permissible power, while the at least one red LED is operated at 100% of its maximum permissible power. The LED luminaire is therefore illuminated in a warmer white, that is to say with a lower color temperature, than was the case in S12. The LED luminaire is switched off again in S15, by operating the switch again.

In the embodiment shown in FIG. 2, the control unit has a memory. This may be a volatile memory (for example EPROM) which allows the most recent operating mode selected on the LED luminaire to be stored. When it is switched off and switched on again, the LED luminaire is now in principle operated in the operating mode which has not been stored in the memory. The operating mode of the LED luminaire therefore fundamentally changes, independently of the time period in which the LED luminaire was switched off.

It is, of course, possible for the LED luminaire to have more than two different operating modes. This means that, for example, it can illuminate in more than two different color temperatures. For this situation, it is then necessary for it to have a memory which is of a size which corresponds at least to the number of different operating modes. Furthermore, in this situation, it is preferable for it fundamentally to be operated first of all in the same operating mode on being switched on for the first time after a time period which is longer than the predetermined time period. This means that, for example, fundamentally, it first of all illuminates in the coldest white which can be selected.

The LED luminaire dealt with in FIG. 2 preferably has a greater number of white LEDs than red LEDs. This means that the maximum permissible power of the emitted white light is greater than that of the red light. For example, it may have six white LEDs and two RGB modules each having a red, green and blue LED, and additionally one red LED.

Figure 3:
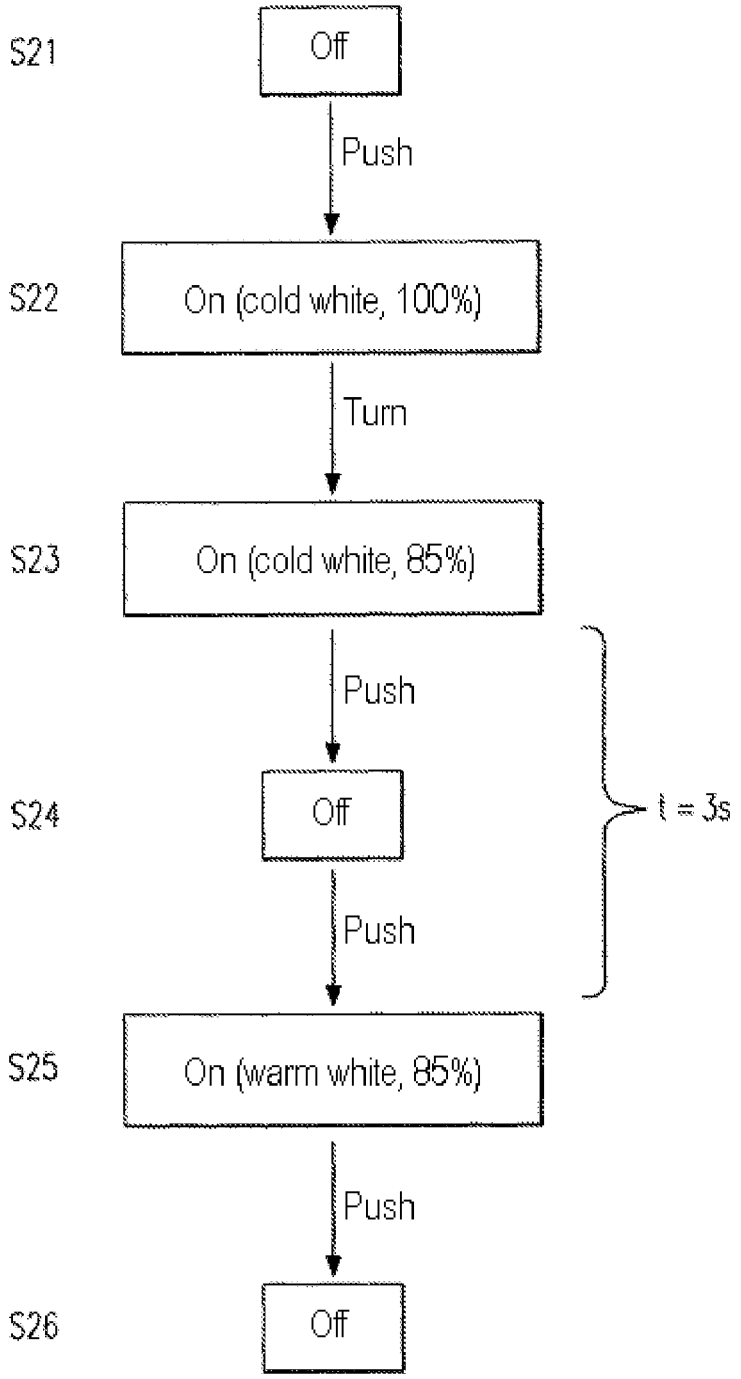
FIG. 3 shows a third embodiment of a method according to the invention for individual adjustment of the color temperature, and of the dimming level.

FIG. 3 shows an embodiment of a method according to the invention in which a dimming switch is used. The LED luminaire is switched off in S21. The LED luminaire is switched on by pushing the dimming switch, which corresponds to operation of a pushbutton. First of all, it illuminates in cold white in 822. In this case, it has a luminous power of 100% of the maximum permissible power. The selected dimming value is therefore 100%. The LED luminaire is now dimmed by operation of the dimming switch, and, by way of example, this may be achieved by turning, pushing etc. the dimming switch. It therefore still illuminates in cold white in S23, but is now at only 85% of the maximum permissible power. If the pushbutton is now operated, that is to say the dimming switch is pushed once, then the LED luminaire is switched off in S24. If it is now switched on again within a predetermined time period t of, for example, 3 s, however, then it now illuminates with the same power, but with a different color temperature. The LED luminaire therefore has a lower color temperature, for example, in S25, which corresponds to the emitted light being a warmer white. The LED luminaire is switched off in S26 by operating the pushbutton again.

Thanks to the invention, it is therefore possible in a simple manner to vary both the color temperature and the luminous power of the LED luminaire and using already available power supply means. In this case, the color temperature and the luminous power can be adjusted independently of one another on the LED luminaire.

By way of example when using a phase on-gating dimmer as the dimming switch, the dimming switch can be rotated or pushed to gate-off a greater or lesser extent of the phase of the mains voltage which is transmitted via the interface, depending on the operation of the rotating dimmer. This changed voltage of the interface can be evaluated by evaluation electronics in the LED luminaire, and can be used as information for adjusting the color temperature and for adjusting the luminous power of the LED luminaire (for example by pulse-width modulation and/or amplitude dimming).

In one alternative embodiment, the dimming switch can be used in such a way that rotation of the dimming switch, which was originally intended for variation of the luminous power of the LED luminaire, now leads to a change in the color temperature of the light emitted from the LED luminaire. The color temperature of the LED luminaire can therefore be varied continuously. This means that continuously variable adjustment is possible, rather than just being able to select discrete values, for example two different color temperatures. The conversion of the selected value at the dimming switch to a specific color temperature of the emitted light can be carried out via a control unit for the LED luminaire. For this purpose, the control unit can determine the variation of the averaged input voltage or else the input voltage. This is because, normally, rotation of the dimming switch varies the profile of the AC input voltage supplied to the LED luminaire, with a control unit detecting this variation.

The control unit can now determine one or more parameters, which are used to operate the one or more LEDs, as a function of this determined variable. These parameters are preferably pulse-width modulation pulse widths. When using an RGB-LED module having at least one red, green and blue LED, a specific pulse-width modulation pulse width (duty ratio) can therefore be selected individually for each color channel as a function of the averaged input voltage. A more detailed interpretation of this adjustment of an RGB-LED module is explained in FIGS. 4*a* and 4*b*. In addition to continuous adjustment of the color temperature, it is likewise possible to adjust the luminous power of the LED luminaire at least in individual discrete values. For this purpose, multiple operation of the pushbutton of the dimming switch in the manner described above can be analyzed by the control unit. For example, a switched-off LED luminaire can first of all illuminate at 100% of the luminous power by operation of the pushbutton of the dimming switch, when the LED luminaire has previously been switched off for a time period which is more than a predetermined time period. The luminous power can now be reduced by double operation of the pushbutton again, for example with a reduction to 75%. Individual, discrete values of the luminous power can thus be selected.

In one alternative embodiment, the dimming switch can be used such that rotation of the dimming switch also at the same time leads to variation of the color temperature of the light emitted from the LED luminaire, in addition to variation of the luminous power of the LED luminaire. It is therefore possible to also vary the color temperature of the LED luminaire at the same time that the brightness is varied. Preferably, the color temperature is shifted in the direction of a warmer color temperature when the brightness (luminous power) is reduced. This simultaneous variation of the color temperature can also be carried out only below a specific luminous power.

Figure 4B:
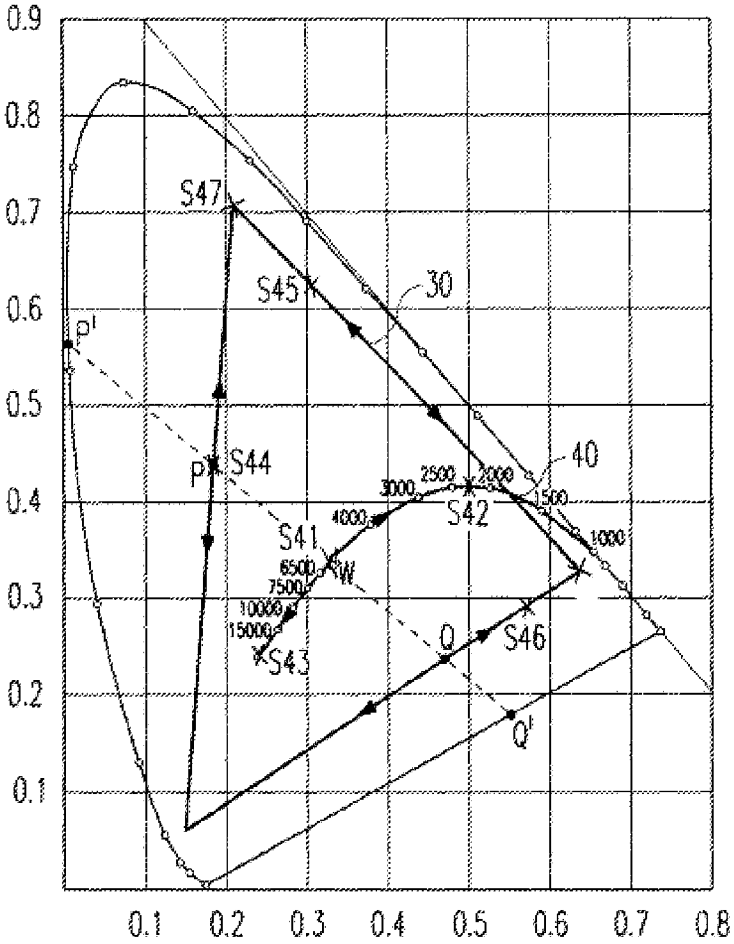
FIG. 4*b* shows a fifth embodiment of the method according to the invention for passing continuously through color values on a second curve on the CIE standard color table.
Figure 4A:
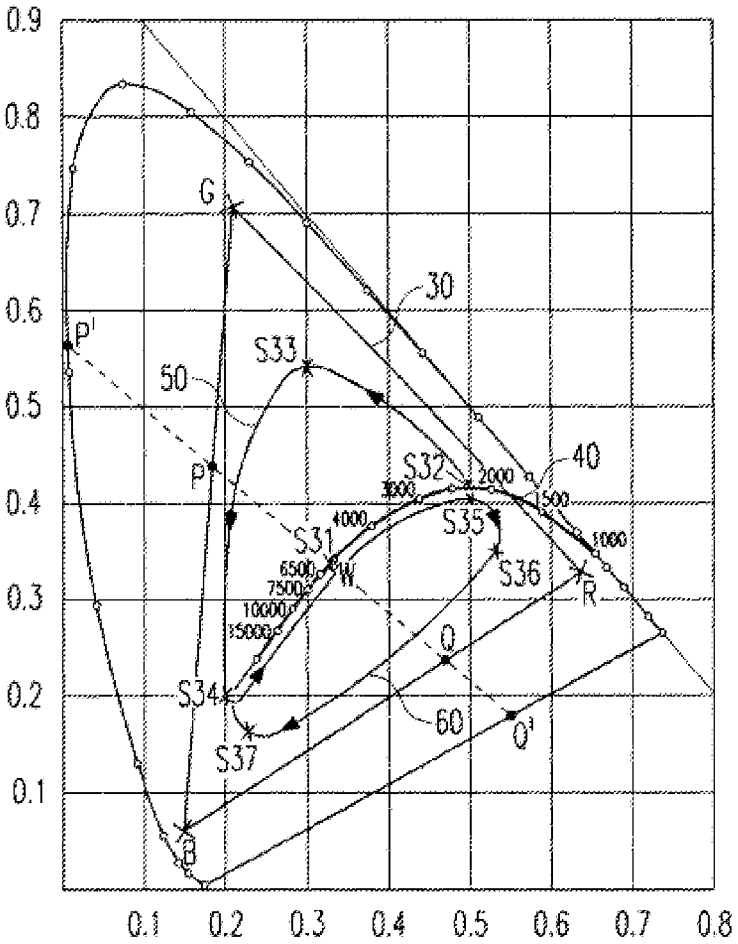
FIG. 4*a* shows a fourth embodiment of the method according to the invention for passing continuously through color values on a first curve on the CIE standard color table.

FIGS. 4*a* and 4*b* show two different embodiments illustrating how the color temperature and the color of the light emitted from the LED luminaire can be varied continuously. In these methods, color values on the CIE standard color table are passed through continuously. In this case, the color values may be located on one or more curves.

The curves are preferably the black body curve and/or a curve which is moved along the color points produced by the LEDs.

The use of a dimming switch is provided for this purpose, with the color temperature and/or the color being varied in the manner as illustrated in FIGS. 4*a* and 4*b* by rotation of the dimming switch. Alternatively, a dimming pushbutton as described initially can also be used for this purpose, in which, when the luminaire is in the switched-on mode, the input voltage to the luminaire is varied by keeping the switch depressed. Furthermore, an RGB-LED module is preferably used.

FIG. 4*a* shows a CIE standard color table/standard color table. The colors of the red, green or blue LED mark the corner points R, G, B of a triangle 30 in this table. In this case, the LED luminaire, that is to say the combination of the light from the red, green and blue LEDs, can assume any point within the triangle 30.

FIG. 4*a* shows a method indicating how the emitted light color, that is to say the point on the CIE standard color table which corresponds to this emitted light, can now be varied by rotation of the dimming switch. In this case, it is desirable to be able to set both different white hues with a different color temperature, and different colors. When the LED luminaire is switched on for the first time, that is to say when it is connected for the first time after a relatively long time period, the LED luminaire is initially preferably illuminated in the most favored setting. In the embodiment shown in FIG. 4*a*, this corresponds to the white point at S31. This is located on the so-called black body curve, which represents different white hues with different color temperatures.

When the LED luminaire is switched on, the process therefore starts with a white hue, although this need not necessarily correspond to the white point, but may also have a higher or lower color temperature. The selected point is now moved on the black body curve in the direction S32 by rotation of the dimming switch. Therefore, in the process, the color temperature is first of all reduced. In this case, S32 represents the white hue with the minimum color temperature which can be selected. Subsequently, the selected point migrates along a half-curve 50. In this case, the half-curve 50 need not be round but, however, may also have angles. A light color which corresponds to the green value which can be selected most intensively is selected at the point S33. The color then varies through turquoise in the direction of blue. The black body curve is once again intercepted at S34, but on this occasion at a very high color temperature. The process now starts from the black body curve again to the point S35. The process now starts from a second half-curve 60, which may likewise be angled and/or round. In this case, a color hue is selected at S36 which corresponds most to a red. In contrast, a color hue is selected at S37 which corresponds most to a blue. The point then migrates over the half-curve 60 and over the black body curve 40 back to the point S31, thus completing the cycle. The process then starts again if the dimming switch is rotated further.

Widely differing white hues with different color temperatures as well as widely differing color hues can be varied and selected continuously in the described manner, and this is possible simply by rotation of the dimming switch. In this case, the black body curve 40 is started from twice as frequently as the remaining color hues on the half-curves 50 and 60, which is advantageous because it is desirable to select white hues more frequently than to select color hues. Alternatively, of course, it is, however, also possible to start from a complete circuit after departure from the black body curve 40, with this circuit consisting of the two half-curves 50 and 60, before once again starting from the black body curve 40.

Furthermore, the method illustrated in FIG. 4*a* makes it possible to vary the color reproduction index CRI, since, for example at the white point at which all the LEDs illuminate with the same intensity, this is higher than if for example, virtually all of the light were to originate from the red LED at the point S36.

Since, in the embodiment shown in FIG. 4*a*, the color and/or the color temperature can be varied from various white hues simply by rotation of the dimming switch, it is additionally possible to vary the brightness of the LED luminaire by pushing the pushbutton of the dimming switch a number of times.

However, in the embodiment shown in FIG. 4*a*, there is a risk of the user being confused when selecting the color temperature and/or the color, because he does not know whether the selected point is actually located on the black body curve 40 or on one of the half-curves 50 and 60. This is because, for example, a white hue on the black body curve 40 with a very high color temperature illuminates in a highly blue form, which may be very similar to a selected color, for example turquoise.

The embodiment illustrated in FIG. 4*b* is intended to overcome this problem. This is achieved by starting from two different curves 30 and 40, which are separated from one another. The separation of the two curves therefore makes it possible for the observer to more easily determine the curve on which the currently selected value is actually located. In this case, a first curve 30 corresponds to all color values which can be selected. In contrast, a second curve 40 corresponds to all white hues which can be selected with a different color temperature. It is possible to change, that is to say jump backwards and forwards, between the two curves 30 and 40 by pushing the pushbutton of the dimming switch twice in the switched-on mode. The operation of the pushbutton therefore no longer has the effect of variation of the emitted luminous power, but results in a change between white and colored light being emitted.

The method which is illustrated in FIG. 4*b* therefore first of all once again starts by initially switching on at the white point at S41. The color temperature of the white hue can now be varied by rotation of the dimming switch. It is therefore possible to start at least from a subarea of the black body curve. The points S42 and S43 are shown here as maximum values, that is to say as the white hue with the highest and the lowest color temperature. The selected value now jumps to a point on the curve 30 by pushing the pushbutton of the dimming switch twice. In this case, this is in the form of a triangle, which is covered by the three colors red, green and blue of the RGB-LED module. This means that only the LEDs of a single color, for example blue, illuminate at each corner point of the triangle. The triangle can now be started from in both directions by rotation of the dimming switch. For example, if the LED luminaire now illuminates with a color which corresponds to the point S44 after the pushbutton has been pressed, then it is possible to start from the triangle via the points S45 and S46 by rotation of the dimming switch in one direction, until the point S44 is reached again.

It is, of course, also possible to start from each curve in the other direction by rotation of the dimming switch in the opposite direction.

When changing from a white hue to a color hue, a color hue which can be clearly distinguished from a white hue is advantageously selected first of all. For example, in principle, the LED luminaire can first of all illuminate in the most intensive green which can be selected, corresponding to the point S47. It is therefore easier for the user to determine whether it has currently selected a white hue or a color hue. Alternatively, however, it is also feasible for the most recently selected color hue or white hue to have been stored by the control unit and for this most recently selected color or white hue to be selected first on renewed selection by pushing the pushbutton.

FIG. 5 shows an exemplary embodiment of an LED luminaire according to the invention. The LED luminaire 1 has control electronics 2 and an LED module 7 which is controlled by the control electronics. The control electronics 2 once again comprise a control unit 3, preferably an integrated circuit, and a memory 4, in which case the control unit 3 and the memory 4 may also represent one element. The integrated circuit is preferably an ASIC or a microcontroller, although hybrid solutions are also possible, consisting of an integrated circuit and further discrete, electrical components. The memory 4 is preferably an at least partially non-volatile memory, such as a flash memory.

In this exemplary embodiment, the LED module 7 has at least one RGB-LED module, consisting of at least one red, one green and one blue LED, with this being referenced by reference symbols 6. Furthermore, it has at least one other LED 5. This may be a dye-converted white LED, that is to say a blue LED in which color conversion means, such as phosphor, are arranged in the outlet angle of the emitted light. This may also be at least one further colored LED, such as a blue or a red LED. In this case, an additional white. LED can be used to produce neutral, that is to say white, light, while a colored LED, such as a red and/or a blue LED, can vary the color impression, that is to say the impression of the color temperature, of the LED module 7. For example, it is possible to use an additional red LED to reduce the color temperature of the light emitted overall from the LED luminaire 1, while the additional use of a blue LED can be used to produce a higher color temperature for the emitted light. In addition, an optical element 8 is advantageously used which, in particular, causes diffusion effects on the light emitted from the LEDs. It may therefore be a diffusion disk. This may consist of glass or a plastic, and may have diffuse particles. It is also feasible for its surface to be roughened or structured. Furthermore, the optical element 8 may have a lens which, for example, is downstream from the diffusion disk.

In order to match the supplied electric current to the parameters required by the LED module 7, the control electronics 2 furthermore have electronics 18, designed for this purpose, for current and voltage reduction. In this case, a current regulation unit is preferably used in order to operate the LEDs with correct parameters, and sets a current which is suitable for the LEDs. The electronics 18 may be regulated by the integrated circuit 3 for this purpose. This regulation is preferably carried out via an internal bus 20. The electronics 18 also have a rectifier, if the LED luminaire 1 is intended to be supplied with an AC voltage.

The electric current which has been matched by the electronics 18 is supplied to a circuit 19 which is designed for pulse-width modulation (PWM). The circuit 19 is also preferably regulated via the internal bus 20 by the integrated circuit 3. The PWM method which is used by the circuit 19 now makes it possible to individually adjust the brightness of the individual LEDs. For this purpose, the circuit 19 may have one or more switches, with the length of time for which the switches are switched on corresponding to the PWM pulse width. The electrical signals produced in this way are supplied via the internal conductors 21 and via the conductors 9 to the LED module 7. In this case, the conductors 21 and 9 preferably have a plurality of channels. Each individual light color of the LED module 7, such as all the red LEDs in the RGB-LED module 6 or the one or more additional white LEDs 5 can thus be controlled individually by one dedicated channel. Additional regulation of the LED module 7 by measurement of the parameters such as current and/or voltage in the conductors 21, or 9 is likewise feasible, with the measured, values being fed back to the integrated circuit 3.

The LED luminaire preferably represents a standard element. This can be mounted on the ceiling or on the wall of a room, and may be connected to the power supply cables. In one preferred embodiment, the LED luminaire is, however, an LED retrofit luminaire, which can be screwed or plugged into a conventional lamp socket. For this purpose, the LED luminaire preferably has a screw thread 22, for example an E14, E27 or E47 lamp cap, or alternatively a halogen plug or a bayonet fitting. Electric current is supplied to the LED luminaire 1 via a connection 22 such as this.

The connection 22 of the LED luminaire 1 therefore represents an interface 23 of the LED luminaire 1, via which the latter receives electrical signals. In addition, the LED luminaire 1 may also have a further interface 14 which, for example, can be used for connection of the LED luminaire 1 to a communication bus of a lighting system. However, this is an optional feature of the LED luminaire 1. In principle, it is also feasible for signals also to be received and/or transmitted in digital form via each interface, that is to say digital commands, for example in accordance with the DALI Standard.

The LED luminaire 1 therefore has a connection 22, such as a screw socket or a plug. These represent an interface 23 for the LED luminaire 1 to an appropriate lamp socket 13. The lamp socket 13 is also connected to a conductor 24, with this preferably being conventional domestic wiring. The wiring 24 is therefore routed within the ceilings and/or walls of the building, and is connected to a switch 10. The switch 10 may be a toggle switch, pushbutton, dimming switch, rotating dimming switch or a dimming pushbutton, as described above. Furthermore, the switch 10 is connected to a supply voltage 12, such as the mains AC voltage. The switch 10 also represents a user interface between the lighting, and therefore in particular between the LED luminaire 1 and a user 11. The power supply for the LED luminaire 1 can therefore be switched off and on in the manner described above and, furthermore, the power supply to the LED luminaire 1 can be reduced, by operation of the switch 10.

Figure 6:
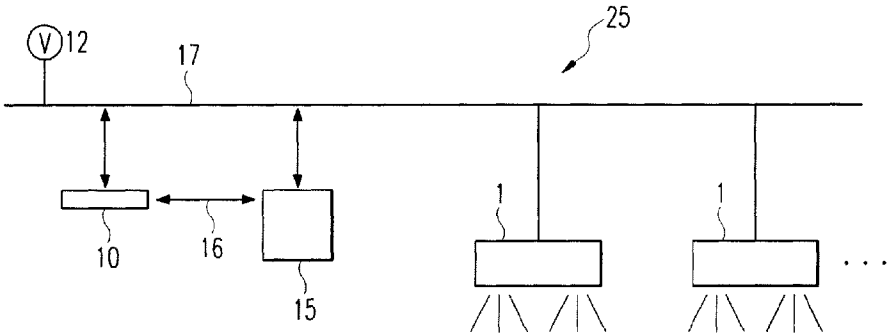
FIG. 6 shows an embodiment according to the invention of an LED lighting system.

Finally, one possible exemplary embodiment according to the invention of an LED lighting system 25 is also intended to be explained in FIG. 6. In this case, this has at least two LED luminaires 1 as described above, which are connected to a bus 17. Furthermore, a central control unit 15 is connected to the bus 17 and is connected directly via a connection 16 and/or via the bus 17 to a user interface 10. The user interface 10 is, in the simplest case, a switch as described above. However, alternatively, it may also be some other input option, for example a keypad or a touch screen. The user interface 10 may likewise have an output unit, such as a display, a touch screen or an audible output, such as a voice output. The bus 17 is used for communication between the central control unit 15 and the connected LED luminaires 1. In one preferred embodiment, it is furthermore used to supply power to the connected elements. For this purpose, it may be connected directly or else via a mains switching unit to the mains alternating current. The LED lighting system 25 makes it possible for the user to adjust the brightness and in particular the color and/or color temperature of the lighting in one or more areas. This is particularly worthwhile when an area is illuminated by a plurality of luminaires, and all the luminaires are therefore intended to have the same or different characteristics, for example the same color temperature. Furthermore, the described relatively extensive user interface 10 makes it possible to implement further selection options for the lighting, for example by setting individual LED luminaires differently, and to obtain more detailed information about the functionality of the lighting system, and the selected parameters.

However, in principle, the LED luminaire 1 according to the invention makes it possible to use a plurality of the LED luminaires 1 in an area, and to control them by means of a single toggle switch, pushbutton or dimming switch. The uniformity of the overall illumination is in this case achieved by supplying the same switch on/off signals and dimming signals to all the LED luminaires 1. In addition, there is no need for a separate output unit at the interface 10, since the lighting is already adequately informed about the selected parameters, thanks to the invention.

LIST OF REFERENCE SYMBOLS

1 LED luminaire
2 Control electronics
3 Control unit
4 Memory
5 LED
6 RGB-LED module
7 LED module
8 Optical element
9 Connection between LED module and control unit
10 User interface
11 User
12 Power supply
13 Lamp socket
14 Additional interface
15 Central control unit
16 Connection between user interface and central control unit
17 Bus
18 Current and/or voltage matching
19 PWM circuit
20 Internal bus of the control unit
21 Conductor
22 Connection of the LED luminaire
23 Interface of the LED luminaire and of the luminaire socket
24 Supply conductor
25 LED illumination system
30 RGB triangle in the CIE standard color table
40 Black body curve
50 First half-curve in the CIE standard color table
60 Second half-curve in the CIE standard color table

The invention claimed is:

1. A method for controlling the operation of an LED luminaire which has a plurality of LEDs as light sources, wherein the method has the following steps:

evaluating, by a microcontroller for the LED luminaire, an electrical signal produced by a toggle or pushbutton switch that is operable by a user and that is connected to the microcontroller, the LED luminaire being supplied with a mains voltage via an interface of the LED luminaire, wherein the mains voltage output by the toggle or pushbutton switch supplies the LED luminaire by means of the toggle or pushbutton switch, and varying the color temperature of the LED luminaire as a function of the evaluated signal in which the microcontroller counts the number of times the toggle or pushbutton switch is operated and an energy buffer in the microcontroller counts the time duration of the operation of the toggle or pushbutton switch, wherein the LED luminaire produces white light, and wherein the color temperature of the white light is varied as the function of the evaluated signal.

2. The method as claimed in claim 1, wherein a duty ratio of a pulse-width modulation operating the at least one of the LEDs is varied as the function of the evaluated signal.

3. The method as claimed in claim 1, wherein the signal is also evaluated for brightness control of the LED luminaire.

4. The method as claimed in claim 1, further comprising the step of:

supplying the mains voltage from an external source, wherein the mains voltage supplied by the toggle or pushbutton switch are selected from the group consisting of interruptions of the mains voltage and application of higher frequency signals to modulate the mains voltage.

5. The method as claimed in claim 1, wherein the time period of interruption of the electrical signal produced by the toggle switch or the pushbutton switch is less than or equal to three seconds.

6. An LED luminaire, having:

a supply circuit which supplies a plurality of LEDs as light sources from a supply voltage, a microcontroller, configured to evaluate an electrical signal produced by a toggle or pushbutton switch, which can be operated by a user and is connected to the microcontroller the LED luminaire being supplied with a mains voltage via an interface of the LED luminaire, wherein the interface is configured to receive the mains voltage through the toggle or pushbutton switch, and wherein the microcontroller is furthermore configured to vary the color temperature of the LED luminaire as a function of the evaluated signal, in which the microcontroller counts the number of times the toggle or pushbutton switch is operated and an energy buffer of the microcontroller counts the time duration of the operation of the toggle or pushbutton switch, wherein the LED luminaire produces white light, and wherein the color temperature of the white light is varied as the function of the evaluated signal.

7. The LED luminaire as claimed in claim 6, wherein a duty ratio of a pulse-width modulation operating the at least one of the LEDs as the function of the evaluated signal.

8. The LED luminaire as claimed in claim 6, in which the microcontroller furthermore also evaluates the signal for brightness control of the LED luminaire.

9. The LED luminaire as claimed in claim 6, in which the light sources have at least one RGB-LED module.

10. The LED luminaire as claimed in claim 6, in which the light sources have at least one dye-converted white LED and at least one further colored LED, whose intensities can be controlled independently by the microcontroller.

11. The LED luminaire as claimed in claim 6, which is in the form of a retrofit lamp and has a halogen or incandescent-lamp cap or halogen lamp pins.

12. The LED luminaire as claimed in claim 6, wherein the supply voltage comprises a mains voltage supplied from an external source, and the mains voltage supplied by the toggle or pushbutton switch are selected from the group consisting of interruptions of the mains voltage and application of higher frequency signals to modulate the mains voltage.

13. The LED luminaire as claimed in claim 6, wherein the time period of interruption of signals produced by the toggle switch or the pushbutton switch is less than or equal to three seconds.

14. A method for controlling the operation of an LED luminaire which has a plurality of LEDs as light sources, wherein the method has the following steps:

evaluating, by a microcontroller for the LED luminaire an electrical signal produced by an on/off switch that is operable by a user and that is connected to the microcontroller, the LED luminaire being supplied with a mains voltage via an interface of the LED luminaire, wherein the mains voltage output by the on/off switch supplies the LED luminaire by means of the on/off switch, and varying the color temperature of the LED luminaire as a function of the evaluated signal, in which the microcontroller counts the number of times the on/off switch is operated and an energy buffer in the microcontroller counts the time duration of the operation of the on/off switch, wherein the LED luminaire produces white light, and wherein the color temperature of the white light is varied as the function of the evaluated signal.

* * * * *